United States Patent [19]

Bayliss et al.

[11] Patent Number: 4,563,007

[45] Date of Patent: Jan. 7, 1986

[54] GOLF CLUB SHAFTS

[75] Inventors: George T. Bayliss, North Stourbridge; Edward S. Ahmad; John A. Hutchcocks, both of Birmingham, all of England

[73] Assignee: Ti Accles & Pollock Limited, West Midlands, England

[21] Appl. No.: 423,520

[22] Filed: Sep. 27, 1982

Related U.S. Application Data

[63] Continuation of Ser. No. 242,292, Mar. 10, 1981, abandoned.

[30] Foreign Application Priority Data

Mar. 13, 1980 [GB] United Kingdom ..... 8008593

[51] Int. Cl.[4] ..... A63B 53/00

[52] U.S. Cl. ..... 273/77 A; 273/80 B

[58] Field of Search ..... 273/77 A, 77 R, 80 R, 273/80 B; 29/407, 558

[56] References Cited

U.S. PATENT DOCUMENTS

| | | | |
|---|---|---|---|
| 1,974,389 | 9/1934 | Cowdery | 273/80 B |
| 2,822,174 | 2/1958 | Brandon | 273/80 R |
| 3,395,571 | 8/1968 | Murdoch | 273/77 A X |
| 3,473,370 | 10/1969 | Marciniak | 273/77 A X |
| 3,871,649 | 3/1975 | Kilshaw | 273/77 A |
| 4,122,593 | 10/1978 | Braly | 273/77 A |
| 4,157,181 | 6/1979 | Cecka | 273/80 R |
| 4,200,286 | 4/1980 | Bennett | 273/77 A |

*Primary Examiner*—George J. Mario

*Attorney, Agent, or Firm*—Kemon & Estabrook

[57] ABSTRACT

A set of golf club shafts that are produced wherein the torsional stiffness of each shaft within the set as a function of its length, be within 5% of a straight line having a gradient lying between zero and a positive value. Each shaft of the set of golf club shafts is formed of a desired length with the outer diameter and thickness of each shaft being varied throughout its length from the large diameter hand gripping end portion through the central stepped portion to the small diameter end or head portion. The clubs of a set are fabricated to the required torsional stiffness with the clubs of a set matched with regard to torsional stiffness.

5 Claims, 7 Drawing Figures

Fig. 1
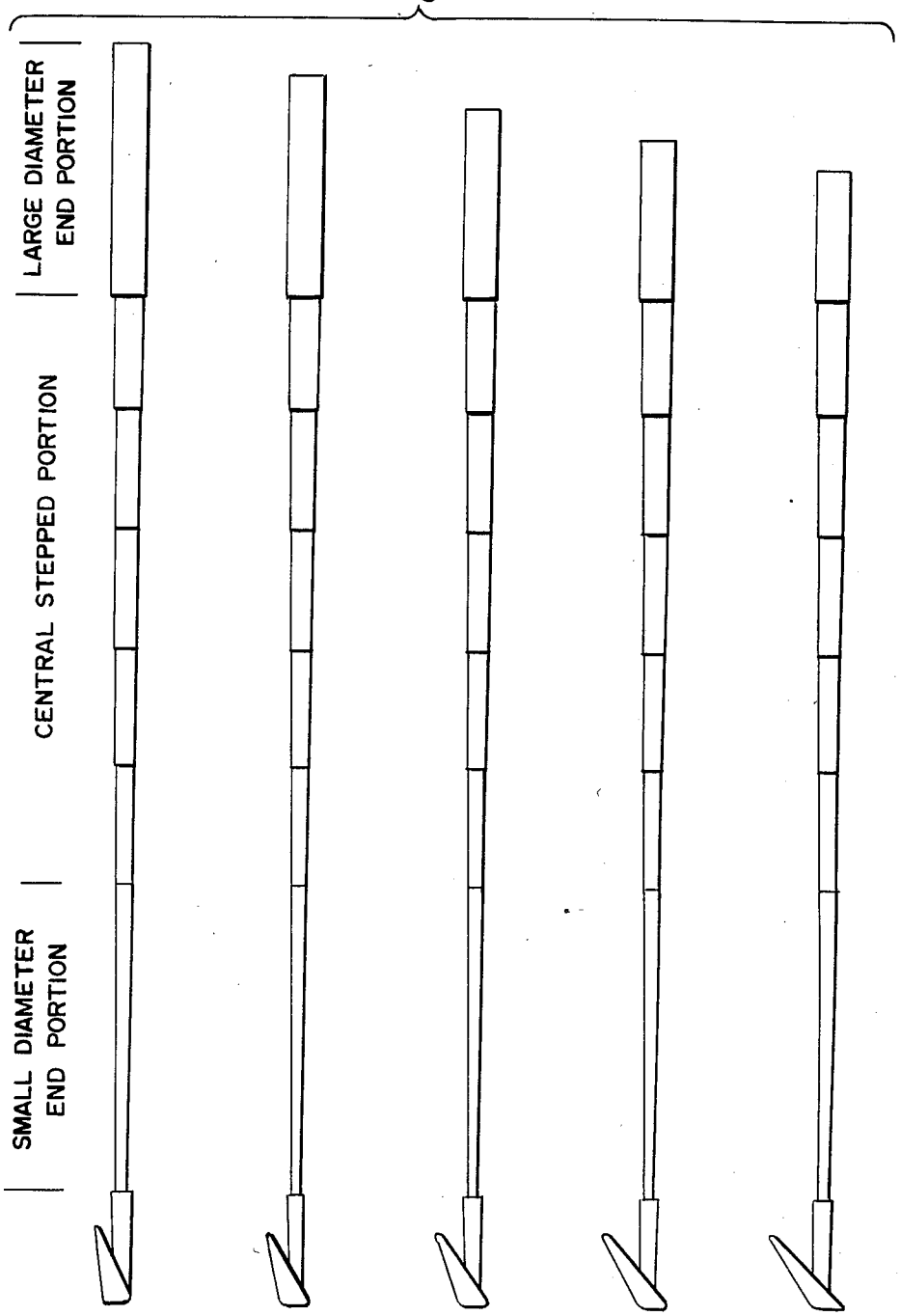
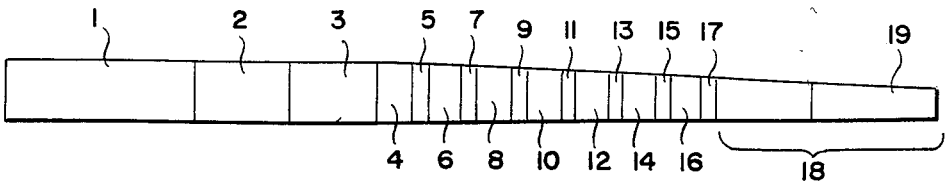
Fig. 3

Fig. 5 (EXAMPLE A-PRIOR ART)

Fig. 6 (EXAMPLE B-PRIOR ART)

GOLF CLUB SHAFTS

This application is a continuation of application Ser. No. 242,292, filed Mar. 10, 1981, now abandoned.

The present invention relates to the manufacture of golf club shafts and in particular to the matching of sets of gold club shafts.

Conventionally in a set of golf clubs, the club shafts vary in length, for example the lengths may differ in one or half inch increments from 39" to 35" for "irons" and from 45" to 42" for "woods". These sets of shafts, apart from the differences in length, are substantially identical in external appearance, for example having a step pattern in which the lengths and dimensions of the steps are constant from shaft to shaft, although it may be that shafts for the "woods" have one or two additional steps as compared to the shafts for the "irons".

Furthermore, it is common practice to match one or more of the physical characteristics of each shaft in a set, in an attempt to produce a set of shafts which will provide a uniform reaction to a consistent golf swing. The physical characteristics that have been used to match golf club shafts in the past, include: the mass of the shaft, the bending frequency of the shaft, and also the static shaft deflection.

In use, torsional loads are induced into a golf club shaft during the swing and to a greater degree at the point of impact of the golf club head with the ball or the ground. During the swing, the shaft accelerates pulling the head of the club after it, the club head is offset from the centre line of the shaft, this therefore induces a torsional stress in the shaft.

At some point before impacting the ball, the momentum of the head carries it past the shaft, thus twisting the shaft in the opposite direction. This twisting of the shaft is then reversed and maximised by the impact of the head with the ball or the ground. If no account is taken of this twisting of the shaft when matching sets of shafts, it may well be that there is a wide variation in the degree of deflection that occurs from shaft to shaft within the set. Consequently it may prove difficult to control the direction in which the ball will be projected.

We have now found that it is advantageous to match a set of golf clubs or shafts therefor with respect to their torsional chaaracteristics. In order to achieve this, it is necessary to be capable of producing a golf club shaft having a specific torsional characteristic.

According to one aspect, the present invention provides a method of manufacturing a golf club shaft of desired length, in which the outer diameter and thickness of the shaft are varied along its length and the material from which the shaft is made is selected; to produce a shaft of predetermined desired torsional stiffness (as hereinafter defined).

According to another aspect, the present invention provides a matched set of golf clubs or shafts therefor, in which the torsional stiffness (as hereinafter defined) of each club or shaft is substantially constant or increases substantially uniformly with increase in length throughout the set. Preferably the torsional stiffness over a set of shafts, or the incremental increase of torsional stiffness from shaft to shaft in the set, varies by less than 5% of the mean torsional stiffness for the set.

For a golf club shaft:

$$\text{Torsional Stiffness} = \frac{LT}{\theta} = JC$$

where:

L is the length of the shaft;

T is the torsional load applied to the shaft;

$\theta$ is the angular deflection of the shaft;

J is the mean 2nd moment of area of the shaft; and

C is the torsional modulus of the material.

The mean 2nd moment of area of the shaft;

$$J = \frac{L}{\frac{L_1}{J_1} + \frac{L_2}{J_2} + \frac{L_3}{J_3} + \ldots \frac{Ln}{Jn}}$$

where; $J_1$; $J_2$; $J_3$ etc. are the 2nd moments of area of each of the step portions of the shaft.

$$= \frac{\pi}{32}(D_1^4 - d_1^4) \text{ etc.}$$

where;

$D_1$ = the outside diameter of the step portion of the shaft $d_1$ = the inside diameter of the step portion of the shaft;

$L_1$; $L_2$; $L_3$; etc. are the lengths of each of the step portions of the shaft; and L is the overall length of the shaft.

Consequently in order to maintain constant torsional stiffness throughout a set of shafts, for a constant torsional load it is necessary to maintain the ratio $L/\theta$ at a constant value. The amount of angular deflection $\theta$ of the shaft for a given torsional load T, is not only proportional to the length L of the shaft but also to the mean diameter and wall thickness of the shaft. For example, if the shaft is of constant wall thickness, angular deflection $\theta$ will decrease with increasing diameter and for shafts of constant diameter, angular deflection $\theta$ will decrease with increasing wall thickness.

One method of producing a set of golf club shafts, used hitherto, is to maintain a constant length grip portion, constant length dimensions over the central stepped portion and constant overall mass. Length variations are provided by modifying the length of the small diameter end portion and by increasing or decreasing the thickness in order to provide constant mass. For a typical golf club shaft, the torsional stiffness of the smaller diameter end portion will be below the average torsional stiffness for the shaft and that of the large diameter end portion will be above average torsional stiffness. If therefore the length of the shaft from shaft to shaft in the set is varied by reducing the length of the small diameter end portion, the average torsional stiffness for each shaft in the set will increase as the length of the shafts decrease. Furthermore, the increase in thickness of the shaft will further decrease the angular deflection O, increasing the torsional stiffness. As a result, this method of producing shafts can give a variation in the torsional stiffness of about 20% across a set of shafts, as illustrated by Line A in the graph, shown in FIG. 4.

The variation in torsional stiffness may be reduced to about 10%, as illustrated by Line B of the graph, shown in FIG. 4, by maintaining a constant wall thickness. This of course will be at the expense of the uniformity of the shaft weights.

According to a further aspect of the present invention a method of producing a set of golf clubs or shafts therefore comprises maintaining the lengths of the small diameter end portion or head carrying portion and central stepped portion of the shaft constant and decresing the length of the hand gripping or large diameter end portion, whilst increasing the wall thickness of the shaft, or vice versa, so as to produce a set of shafts in which the torsional stiffness (as hereinbefore defined), of each shaft is substantially constant or increases substantially uniformly with increase in length.

By reducing the length of the hand gripping or large diameter end portion of the shaft, the angular deflection O of the shaft will be reduced proportionally to a smaller degree than the length L of the shaft. The ratio L/O and consequently the torsional stiffness of the shaft will decrease. This decrease in torsional stiffness can be corrected to give a constant value over the set by increasing the wall thickness of the various portions of the shaft, thereby further reducing the angular deflection O and increasing the L/O ratio and torsional stiffness. The increase in wall thickness will also, to a certain degree, compensate for the loss in mass of the shaft due to its reduction in length.

Alternatively, the wall thickness of the various portions of the shaft may be increased in order to provide a set of shafts in which the torsional stiffness increases uniformly with the length of the shaft. In particular, it is advantageous to match the set in this manner, such that the torsional deflection for a given torsional load, of each shaft in the set, is substantially constant, or preferably varies by less than 5% throughout the set.

The invention is now described, by way of example only, with reference to the accompanying drawings, in which:

FIG. 1 is a diagrammatic representation of a set of golf clubs having shafts formed in accordance with the present invention and a matched set of heads;

FIG. 3 is a diagrammatic representation, in elevation, of one of the shafts shown in FIG. 2.

EXAMPLE A

Figure 4:
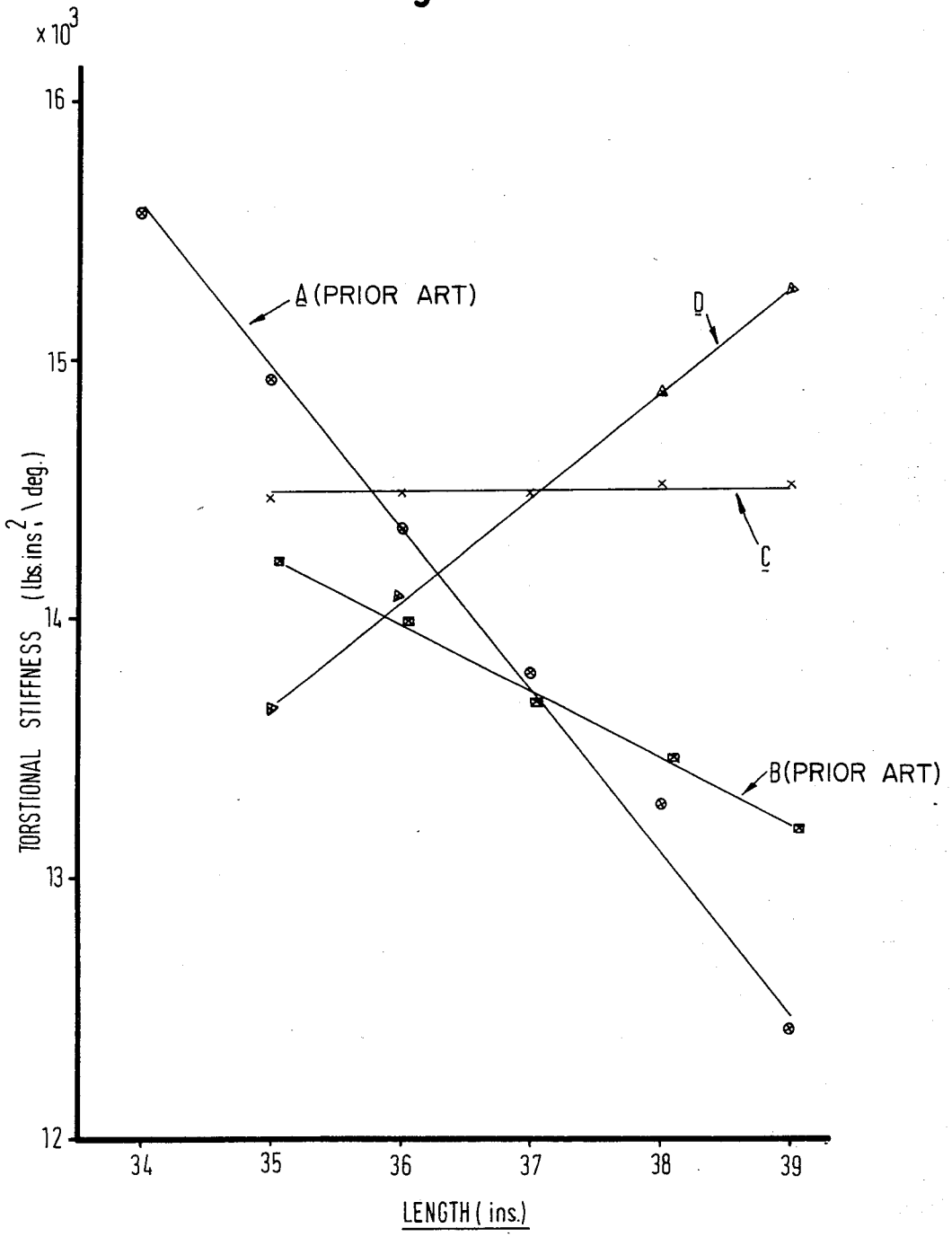
FIG. 4 is a graph showing the relationship between torsional stiffness and shaft length, lines A and B being plots for sets of shafts formed in accordance with conventional methods, as illustrated in Examples A and B respectively and lines C and D being plots for sets of shafts formed in accordance with the present invention, as illustrated in Examples C and D respectively.
Figure 5:
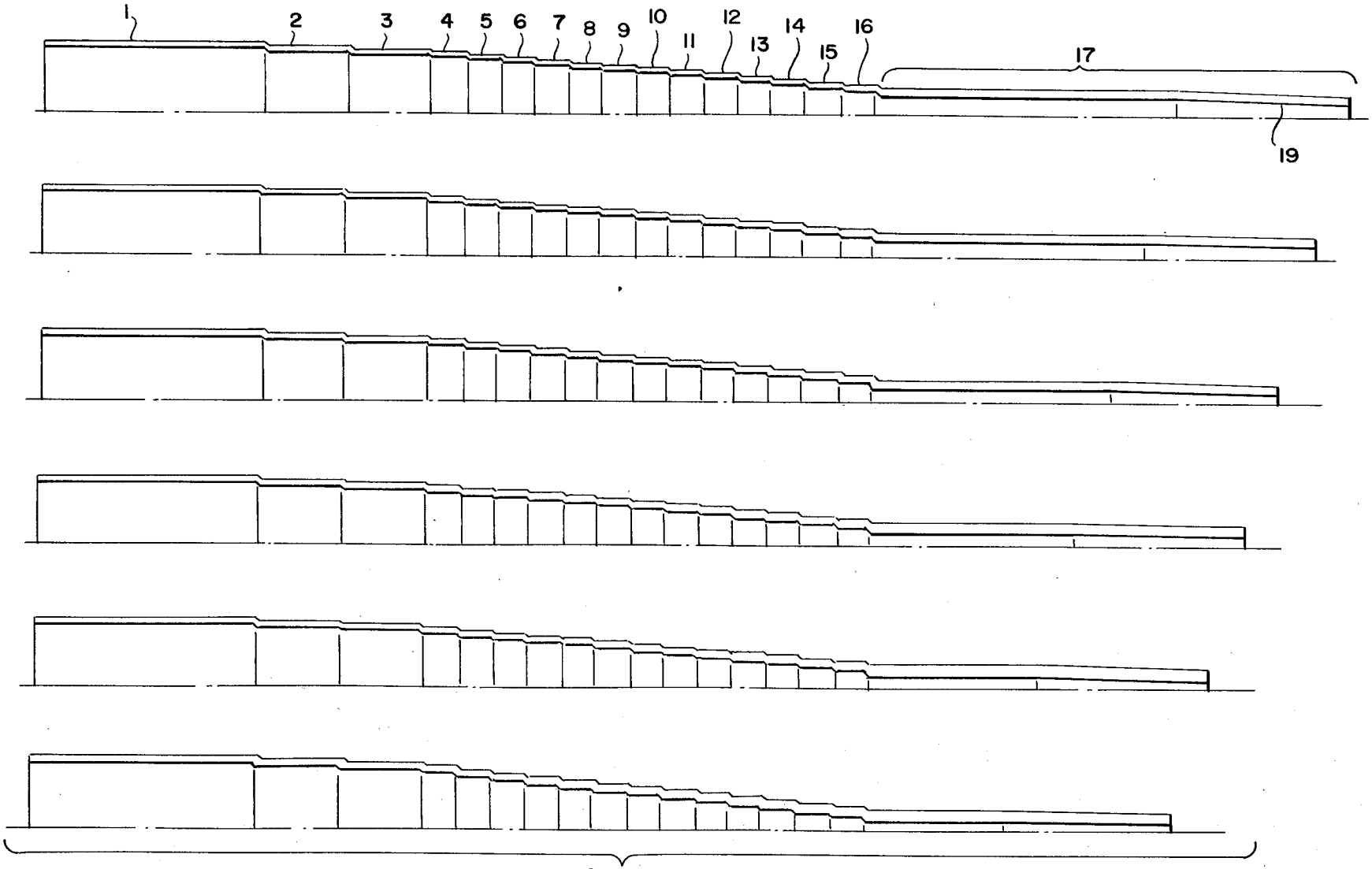
FIG. 5 is a diagrammatic part sectional representation of a set of golf club shafts formed by a conventional method, as illustrated by Example A.

A set of six golf club shafts corresponding to the representation illustrated in FIG. 5 and of the dimensions given in Table I (Example A) was produced by maintaining the lengths and diameters of the large diameter or hand engaging end portion 1 of FIG. 5 and step portions 2 to 16 of the shaft, FIG. 5, constant and reducing the length of the small diameter end or head portion 17, FIG. 5, in inch increments, from 14.5 to 9.5 inches. The thickness of the various steps of the shaft was also varied as illustrated in Table IIA, in order to compensate for the reduction in length, so that all six shafts were of the same weight as illustrated in Table III. As shown in Table III and plot A of the graph shown in FIG. 4, as the shafts thus produced decrease in length, the torsional stiffness of the shaft increases quite rapidly, there being a 21.4% variation over the set of shafts.

EXAMPLE B

Figure 6:
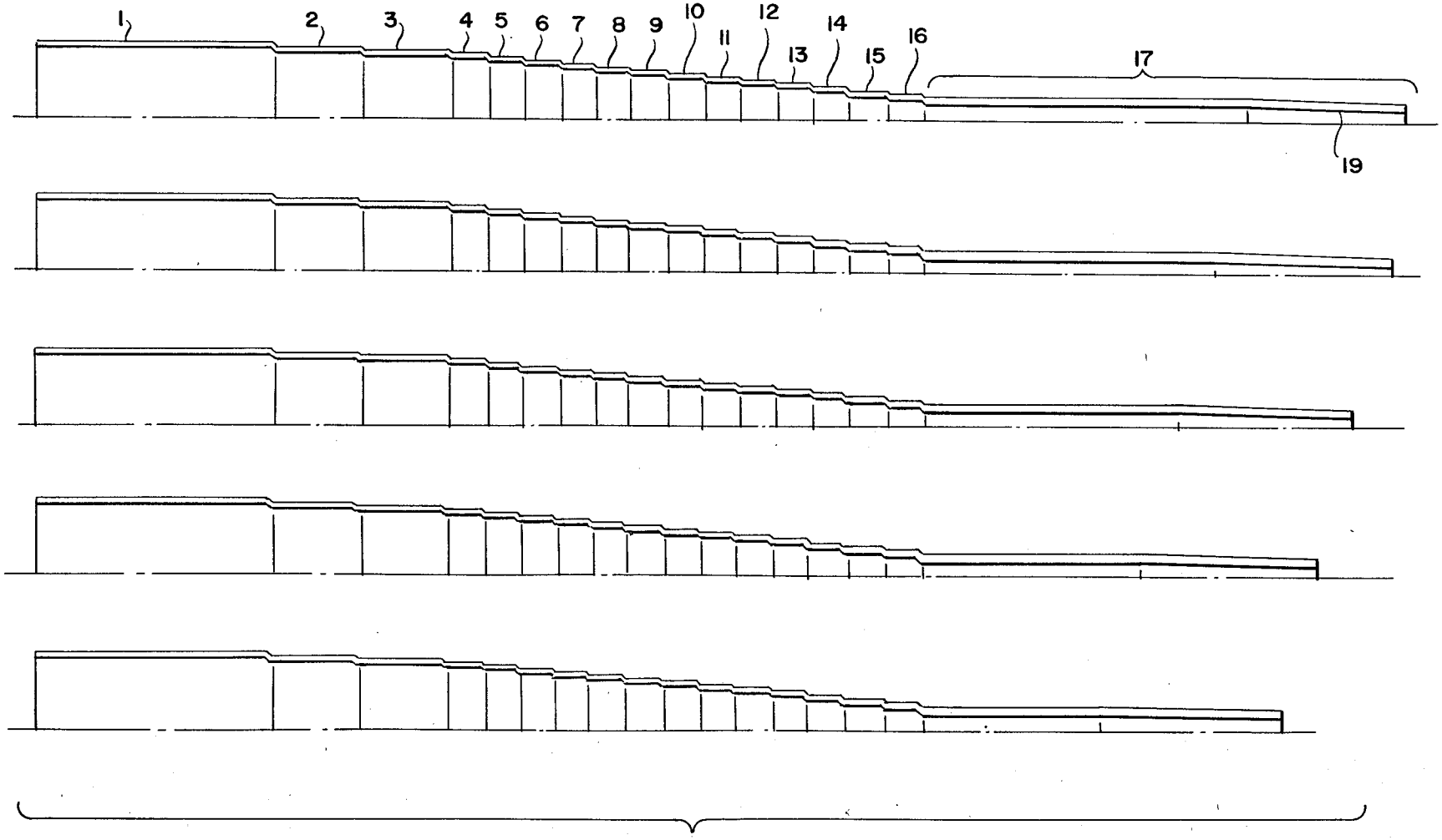
FIG. 6 is a diagrammatic part sectional representation of a set of golf club shafts formed by a conventional method, as illustrated in Example B.

A set of five shafts was produced corresponding to the representation illustrated in FIG. 6 and the dimensions given for 35 to 39 inch shafts of Example A in Table I. The wall thicknesses of the shafts were, however, maintained constant at the values of the 37 inch shaft given in Table IIA. The torsional stiffness of the shafts showed a reduced variation as illustrated by plot B of the graph shown in FIG. 4, but at the expense of a wide variation in the shaft weights.

TABLE I

| | Length (inches) | | Diameter (inches) | |
|---|---|---|---|---|
| Step | Example A (Prior Art) | Example C | Example A (Prior Art) | Example C |
| 1 | 6.5 | 8.5–4.5 | 0.5800 | 0.6000 |
| 2 | 2.5 | 3.0 | 0.5700 | 0.5900 |
| 3 | 2.5 | 3.0 | 0.5600 | 0.5750 |
| 4 | 1.0 | 1.5 | 0.5480 | 0.5650 |
| 5 | 1.0 | 0.5 | 0.5360 | 0.5500 |
| 6 | 1.0 | 1.5 | 0.5240 | 0.5400 |
| 7 | 1.0 | 0.5 | 0.5120 | 0.5250 |
| 8 | 1.0 | 1.5 | 0.5000 | 0.5150 |
| 9 | 1.0 | 0.5 | 0.4880 | 0.5000 |
| 10 | 1.0 | 1.5 | 0.4760 | 0.4900 |
| 11 | 1.0 | 0.5 | 0.4640 | 0.4750 |
| 12 | 1.0 | 1.5 | 0.4520 | 0.4650 |
| 13 | 1.0 | 0.5 | 0.4400 | 0.4500 |
| 14 | 1.0 | 1.5 | 0.4280 | 0.4400 |
| 15 | 1.0 | 0.5 | 0.4160 | 0.4250 |
| 16 | 1.0 | 1.5 | 0.4040 | 0.4150 |
| 17 | 14.5–9.5 | 0.5 | 0.3920 | 0.4050 |
| 18 | — | 10.5 | — | 0.3950 |
| TIP | — | — | 0.3550 | 0.3550 |
| TAPER 19 | 5.0 | 5.35 | — | — |

TABLE II A

| | (Example A) Thickness (thousandths of an inch) | | | | | |
|---|---|---|---|---|---|---|
| Step | 39" shaft | 38" shaft | 37" shaft | 36" shaft | 35" shaft | 34" shaft |
| 1 | 13.35 | 13.68 | 14.03 | 14.14 | 14.78 | 15.19 |
| 2 | 13.47 | 13.81 | 14.16 | 14.52 | 14.91 | 15.32 |
| 3 | 13.59 | 13.93 | 14.28 | 14.66 | 15.05 | 15.46 |
| 4 | 13.75 | 14.09 | 14.44 | 14.82 | 15.22 | 15.63 |
| 5 | 13.90 | 14.25 | 14.61 | 14.99 | 15.39 | 15.81 |
| 6 | 14.06 | 14.41 | 14.78 | 15.16 | 15.57 | 16.00 |
| 7 | 14.23 | 14.59 | 14.96 | 15.35 | 15.76 | 16.19 |
| 8 | 14.41 | 14.76 | 15.14 | 15.53 | 15.95 | 16.39 |
| 9 | 14.59 | 14.95 | 15.33 | 15.73 | 16.15 | 16.59 |
| 10 | 14.78 | 15.14 | 15.53 | 15.93 | 16.36 | 16.81 |
| 11 | 14.97 | 15.34 | 15.73 | 16.14 | 16.57 | 17.03 |
| 12 | 15.18 | 15.55 | 15.95 | 16.36 | 16.80 | 17.26 |
| 13 | 15.39 | 15.77 | 16.17 | 16.59 | 17.03 | 17.50 |
| 14 | 15.61 | 16.00 | 16.40 | 16.83 | 17.28 | 17.75 |
| 15 | 15.84 | 16.23 | 16.64 | 17.08 | 17.53 | 18.01 |
| 16 | 16.08 | 16.48 | 16.90 | 17.34 | 17.80 | 18.29 |
| 17 | 21.84 | 22.24 | 22.67 | 23.11 | 23.59 | 24.08 |
| TIP | 24.95 | 25.41 | 25.89 | 26.40 | 26.94 | 27.50 |

EXAMPLE C

Figure 2:
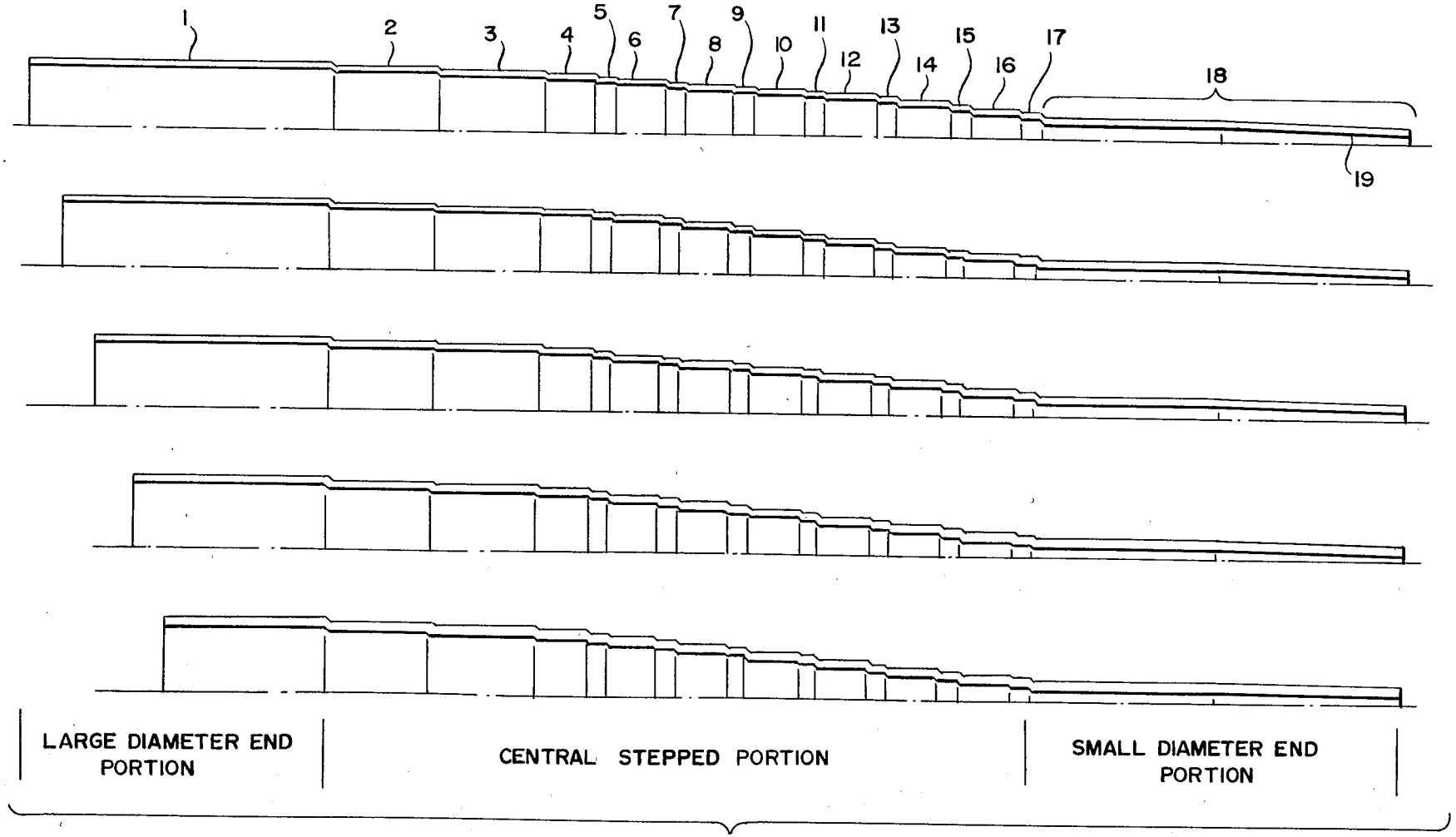
FIG. 2 is a diagrammatic part sectional representation of a set of golf club shafts formed in accordance with the present invention, as illustrated by Examples C and D.

A set of five shafts was produced in accordance with the representations shown in FIGS. 2 and 3 to the dimensions given in Table I (Example C) by maintaining the lengths and diameters of the small diameter end portion 18 and stepped portions 2 to 17 constant, while reducing the length of the large diameter end portion 1, in inch increments between 8.5 and 4.5 inches. The wall thickness of the various steps of the shaft were varied in accordance with Table IIC, so that the resulting shafts had a substantially uniform torsional stiffness, as illustrated in Table III and by plot C of the graph shown in FIG. 4.

EXAMPLE D

A further set of five shafts was produced in accordance with the representation shown in FIGS. 2 and 3 to the dimensions given in Table I (Example C), but in this case the thickness of the various step portions of the shafts were varied in accordance with Table IID, so that the torsional stiffness of the shafts increases substantially uniformly with increasing length as illustrated in Table IV and by plot D of the graph shown in FIG. 4 and also the torsional deflection per unit torsional load for each shaft in the set was substantially constant, as shown in Table IV.

TABLE II C

| | (Example C) Thickness (thousandths of an inch) | | | | |
|---|---|---|---|---|---|
| Step | 39" shaft | 38" shaft | 37" shaft | 36" shaft | 35" shaft |
| 1 | 12 68 | 12.84 | 13.02 | 13.21 | 13.42 |
| 2 | 12.79 | 12.95 | 13.14 | 13.33 | 13.54 |
| 3 | 12.96 | 13.13 | 13.31 | 13.50 | 13.71 |
| 4 | 13.07 | 13.25 | 13.43 | 13.62 | 13.84 |
| 5 | 13.26 | 13.43 | 13.62 | 13.82 | 14.03 |
| 6 | 13.38 | 13.56 | 13.75 | 13.95 | 14.16 |
| 7 | 13.58 | 13.76 | 13.95 | 14.15 | 14.37 |
| 8 | 13.71 | 13.89 | 14.09 | 14.29 | 14.51 |
| 9 | 13.92 | 14.11 | 14.30 | 14.51 | 14.73 |
| 10 | 14.07 | 14.25 | 14.45 | 14.66 | 14.89 |
| 11 | 14.30 | 14.48 | 14.69 | 14.90 | 15.13 |
| 12 | 14.45 | 14.64 | 14.85 | 15.06 | 15.29 |
| 13 | 14.70 | 14.89 | 15.10 | 15.32 | 15.56 |
| 14 | 14.87 | 15.07 | 15.28 | 15.55 | 15.74 |
| 15 | 15.14 | 15.34 | 15.56 | 15.78 | 16.02 |
| 16 | 15.33 | 15.53 | 15.75 | 15.97 | 16.22 |
| 17 | 15.52 | 15.72 | 15.95 | 16.18 | 16.42 |
| 18 | 23.40 | 23.61 | 23.83 | 24.06 | 24.32 |
| TIP | 26.63 | 26.86 | 27.12 | 27.39 | 27.68 |

TABLE III

| Shaft Length (Ins) | 39 | 38 | 37 | 36 | 35 | 34 |
|---|---|---|---|---|---|---|
| Example A | | | | | | |
| Shaft Weight (oz) | 4.25 | 4.25 | 4.25 | 4.25 | 4.25 | 4.25 |
| Head Weight (oz) | 9.8 | 9.8 | 9.8 | 9.8 | 9.8 | 9.8 |
| Torsional stiffness (lbs. in$^2$/deg) | 12814 | 13283 | 13790 | 14335 | 14925 | 15561 |
| Torsional Frequency (Hz) | 58.99 | 60.91 | 62.97 | 65.17 | 67.53 | |
| Example C | | | | | | |
| Shaft Weight (oz) | 4.25 | 4.18 | 4.125 | 4.062 | 4.0 | |
| Head Weight (oz) | 9.8 | 9.8 | 9.8 | 9.8 | 9.8 | |
| Torsional Stiffness (lbs ins$^2$/deg) | 14517 | 14503 | 14491 | 14474 | 14458 | |
| Torsional Frequency (Hz) | 62.79 | 63.65 | 64.55 | 65.49 | 66.47 | |

TABLE II D

| | (Example D) Thickness (thousandths of an inch) | | | | |
|---|---|---|---|---|---|
| Step | 39" shaft | 38" shaft | 37" shaft | 36" shaft | 35" shaft |
| 1 | 13.52 | 13.28 | 13.02 | 12.75 | 12.47 |
| 2 | 13.63 | 13.39 | 13.14 | 12.86 | 12.58 |
| 3 | 13.81 | 13.57 | 13.31 | 13.04 | 12.75 |
| 4 | 13.94 | 13.69 | 13.43 | 13.15 | 12.86 |
| 5 | 14.13 | 13.88 | 13.62 | 13.34 | 13.04 |
| 6 | 14.27 | 14.01 | 13.75 | 13.46 | 13.16 |
| 7 | 14.47 | 14.22 | 13.95 | 13.66 | 13.36 |
| 8 | 14.62 | 14.36 | 14.09 | 13.79 | 13.49 |
| 9 | 14.84 | 14.58 | 14.30 | 14.01 | 13.69 |
| 10 | 15.00 | 14.73 | 14.45 | 14.15 | 13.84 |
| 11 | 15.24 | 14.97 | 14.69 | 14.38 | 14.06 |
| 12 | 15.41 | 15.13 | 14.85 | 14.54 | 14.22 |
| 13 | 15.67 | 15.39 | 15.18 | 14.79 | 14.46 |
| 14 | 15.85 | 15.57 | 15.28 | 14.96 | 14.63 |
| 15 | 16.14 | 15.86 | 15.56 | 15.23 | 14.89 |
| 16 | 16.34 | 16.05 | 15.75 | 15.42 | 15.08 |
| 17 | 16.55 | 16.25 | 15.95 | 15.61 | 15.27 |
| 18 | 24.44 | 24.14 | 23.83 | 23.50 | 23.14 |
| Tip. | 27.82 | 27.48 | 27.12 | 26.73 | 26.33 |

TABLE IV

| | (Example D) | | | | |
|---|---|---|---|---|---|
| Shaft Length (ins.) | 39 | 38 | 37 | 36 | 35 |
| Torsional stiffness (lbs. ins$^2$/deg) | 15281 | 14891 | 14491 | 14073 | 13644 |
| Torsional deflection of shaft (deg/lbs, ins) $\times 10^3$ | 2.55 | 2.55 | 2.55 | 2.56 | 2.57 |
| Head weight (oz) | 9.8 | 9.8 | 9.8 | 9.8 | 9.8 |
| Torsional frequency (Hz) | 64.42 | 64.49 | 64.55 | 64.57 | 64.56 |

This invention applies to both "woods" and "irons", the "woods" and "irons" may be matched together to give a single matched set of clubs or may be matched as individual types to give separate sets of matched "woods" and matched "irons".

Figure 7:
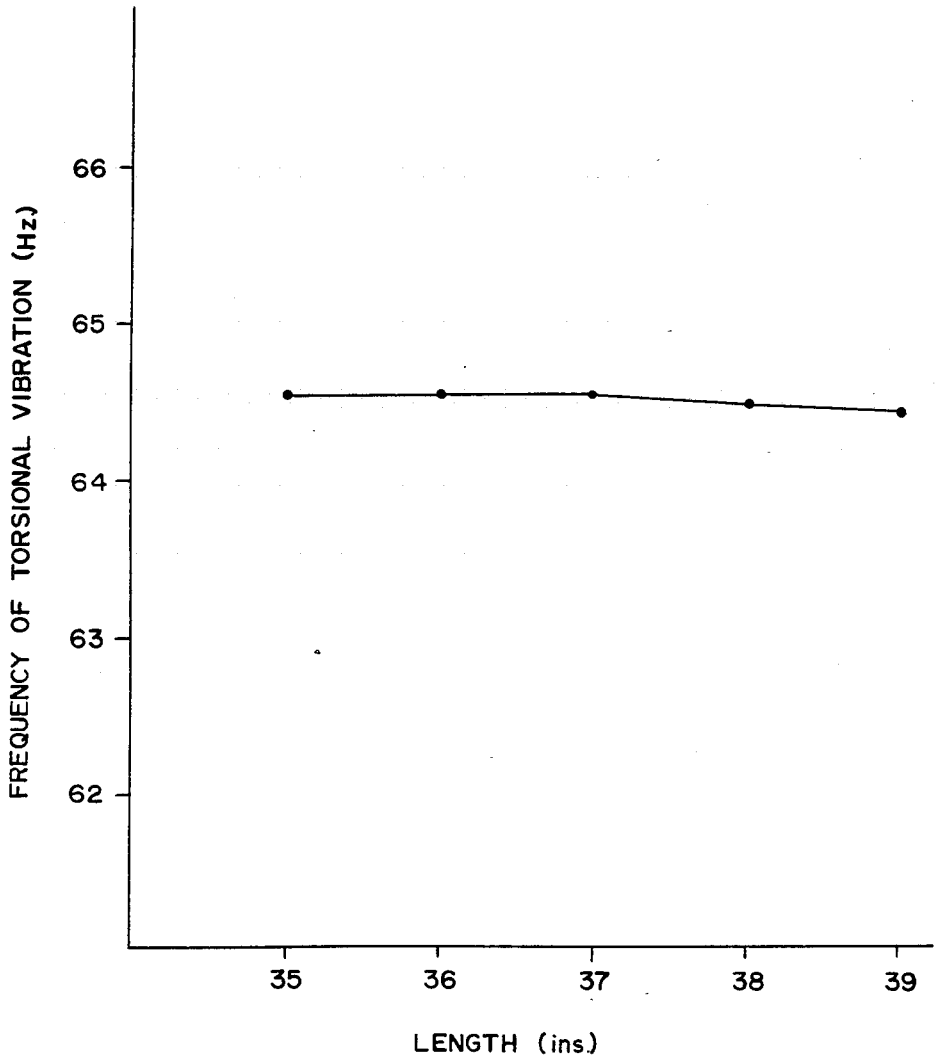
FIG. 7 is a graph showing the relationship between frequency of torsional vibration and shaft length for a set of golf club shafts formed in accordance with the present invention, as illustrated by Example D.

In addition to controlling the torsional stiffness or torsional deflection of the golf clubs or shafts therefore, the present method also produces a set of golf clubs or shafts having substantially constant torsional vibrational frequency as illustrated by FIG. 7 and in the results given in Tables III and IV for the shafts produced in Examples C and D. Consequently a set of golf clubs or shafts therefore produced in accordance with the present invention may be matched with respect to their torsional vibrational characteristics and/or torsional deflection characteristics as well as their torsional stiffness.

Where shafts are matched in respect of torsional characteristics which are affected by the size, shape and mass of the heads fitted thereto, for example torsional deflection or torsional vibrational frequency, the heads are also preferably matched throughout the set as illustrated in FIG. 1, so that the resulting set of clubs are also matched in some manner, with respect to these characteristics.

We claim:

1. A method of producing a set of golf club shafts in which the length of each shaft within the set varies from the other shafts, each shaft being of tubular construction, the outer diameter of which reduces from a large diameter end portion, through a central stepped portion to a small diameter end portion, comprising; forming each shaft of desired length by varying the length of the large diameter end portion while keeping the lengths of the central stepped portions and small diameter end portion constant, and varying the wall thickness with the length of the shaft in order that the torsional stiffness of each shaft within the set as a function of their lengths, lie within 5% of a straight line having a gradient lying between zero and a positive value.

2. A method according to claim 1 in which the torsional deflection of each shaft of a set of golf clubs is within a tolerance level of 5% of the mean torsional deflection for a constant torsional load.

3. A method according to claim 1 in which the torsional vibrational frequency of each shaft is substantially constant throughout the set.

4. A method according to claim 1 wherein club heads attached to said shafts being matched with regard to their size, shape and mass to produce a set of clubs which exhibit constant torsional deflection for constant torsional load throughout the set.

5. A method in accordance with claim 1 wherein club heads attached to said shafts being matched with regard to their size, shape and mass to produce a set of clubs which exhibit constant torsional vibrational frequency throughout the set.

* * * * *